United States Patent [19]

Jansson

[11] 4,000,763

[45] Jan. 4, 1977

[54] METHOD FOR THE PRODUCTION OF CLIPS

[75] Inventor: Olof T. Jansson, Skinnskatteberg, Sweden

[73] Assignee: Clama Industri Aktiebolag, Skinnskatteberg, Sweden

[22] Filed: Apr. 7, 1975

[21] Appl. No.: 565,359

[30] Foreign Application Priority Data

May 24, 1974 Sweden ..... 7406894

[52] U.S. Cl. ..... 140/82; 206/340; 59/77

[51] Int. Cl.[2] ..... B21F 45/24

[58] Field of Search ..... 140/82; 206/340, 345, 206/346; 59/77; 156/178; 93/87

[56] References Cited

UNITED STATES PATENTS

| | | | |
|---|---|---|---|
| 2,224,050 | 12/1940 | Hermann et al. | 140/82 |
| 2,522,656 | 9/1950 | Whalen | 59/77 |
| 2,973,798 | 3/1961 | Powell | 93/87 |
| 3,170,160 | 2/1965 | Burniston | 206/340 |
| 3,613,878 | 10/1971 | Langas et al. | 206/345 |

FOREIGN PATENTS OR APPLICATIONS

| | | | |
|---|---|---|---|
| 1,101,338 | 3/1961 | Germany | 140/82 |

*Primary Examiner*—Lowell A. Larson
*Attorney, Agent, or Firm*—Larson, Taylor and Hinds

[57] ABSTRACT

A method for producing piles of U-shaped clips as used for example to close the ends of sausages or the like. A plurality of wire lengths are formed into a band of parallel adjacent wire lengths, to one side of which is applied a layer of material with a thermo-plastic on the side thereof engaging the band. The wire/layer of material combination is then heated to adhere the wire lengths to the layer of material via the thermo-plastic. The wire/layer of material combination is subsequently cut perpendicular to the lengths of wires and bent to form the clips.

6 Claims, 3 Drawing Figures

METHOD FOR THE PRODUCTION OF CLIPS

Within a plurality of different industrial branches clips are used for constricting hose-shaped bodies. For instance, such clips are used in the manufacture and the filling of sausages, usually in such a way that at the turnover from one sausage to another two such clips are driven over the sausage tightly adjacent to each other with the consequence that the two sausages may be separated from each other by cutting off the sausage skin between the two clips. These clips have the shape of usually at least approximately hair pin bent or U-shaped bent threads, which, at the closing of the sausage skin or the hose-shaped body are bent with their two shanks in X-form over each other tightly adjacent to each other.

Different apparatus and machines for driving such clips have already been proposed. By "driving" clips thereby is meant pushing the clips over the sausage skin and bending the clips in the above mentioned way, so that a tighting constriction of the sausage skin will take place by means of the clips. The techniques used in these machines and apparatus to some extent is similar to the one used in usual staple apparatus or staple book binding machines, although the clips have quite a different shape than the traditional staples. Whereas clips are firstly bent over in U-shape, a staple is, in its not yet closed state, provided with a straight ridge and two straight legs extending perpendicularly to this ridge. Whereas a clips in its closed shape is bent over into screw shape in a little more than one turn, so that the two end parts cross each other under hard contact against each other, it practically never happens that the legs of a staple get in contact with each other, but on the other side they are in line with each other in their closed state. Whereas a staple practically always is close to rectangular in cross-section (sometimes with slightly rounded short sides, but in any case with plane long sides), clips must in order to function be at least approximately circular in cross-section.

The reason for the last mentioned fact is that the staple is guided in such a way that it will in its closed state be positioned in one plane perpendicular to the plane of the paper or papers, respectively, through which the staple is driven, and it is then desirable that the cross-section of the staple is rectangular in order that the required stiffness against deviation sidewardly are be obtained. The clips, on the contrary, shall intentionally guided in such a path that a sideward deviation is created, because otherwise its two ends will not cross each other in the above indicated way.

To simplify feeding of staples they are collected into piles, in which a plurality, for instance 100 staples, are combined by gluing. Therefore it has been regarded as suitable that the clips should also be arranged in this way in piles, but all attempts to cause this hitherto has been without success. The present invention is based upon an investigation of the reason for this.

In this investigation it has proved that the main reason is that the cross-section of clips are rounded, preferably circularly round. Two adjacent clips in a pile would therefore be in contact with each other exclusively along a generatrics line for the wire, from which the clips are produced. A contact surface in the sense proper therefore does not exist between clips adjacent to each other, and a simple gluing of the type, occuring in staples, will therefore also not give the sufficient stiffness without using a surplus of gluing means, so that the "grooves" between the two circularily cylindrical surfaces will be filled with this gluing means. Trying to produce piles of clips in this way, i.e. with a surplus of gluing means, causes the result that they do not function in the apparatus or machine, because the gluing means will cause too strong a bond between the two clips adjacent to each other and if one would decrease the quantity of gluing means, then instead the pile will not be coherent, when it is stored, transported or introduced into the apparatus or the machine, respectively. Another reason has proved to be that in practice it is impossible to produce a pile of clips in the same way which was hitherto used when producing staples. In the production of staples, as a matter of fact, one first cuts the staples into straight pieces, which are arranged side at side, and one thereafter creates the gluing bond, and thereafter one bends the "band" thus created along both edges for simultaneously forming the legs along all of the mutually coherent staples. Another order of sequence between the different steps of manufacture is not possible in practice, because it is too laborious and difficult to arrange staples adjacent to each other, if they are already bent over to form a ridge and legs, and thereafter to glue them together into piles. If one would try to use this method of manufacture in connection with clips, the gluing made between the separate clips forming pieces of wire would not withstand the existing strains, and the gluing bond will burst. This depends upon that the legs of a staple are rather short as compared with its length of the ridge, but the clips are, as mentioned above, approximately shaped like a hair pin, and if one could speak about a "ridge" in connection with the bend in the middle part of the clips this would anyway be very short as compared with the length of the legs.

All attempts to produce clips in piles which could be used for mechanical feeding into clips driving machines therefore have hitherto been without success. The present invention regards doing away with this disadvantage. It is also so that in the clips driving machines hitherto existing the clips were used free from each other, so that they did not form a pile and one has thereby fed them by hand, still without interior connection, into a feeder channel, through which they were brought to the place of driving in the machine. This caused the result that all known clips driving machines worked with a low working speed and required extremely great manual work.

The present invention therefore relates to a method for the production of clips in the form of piles of clips from round wire, releasably connected to each other, and having a rounded upper part and in their non-closed state straight shanks.

According to the invention the clips forming round wire is fed in a way, known from the production of staples, from a greater number of reels arranged in parallel to each other, to a banding apparatus, in which said wires are arranged in a position adjacent each other. Thereafter, on the wire band thus formed, the layer of paper or a similar material is placed, which, at least on its side turned to the wires, is covered by plastic. This plastic is formed by a thermo-plastic material with a melting point which is well below the interval of temperatures at which the paper or the like is burnt or will loose observably in strength. Thereafter, a quick heating of the surface of the wire band turned to the paper, along with the paper and the plastic cover takes place up to or a little above the melting temperature of the plastic, followed immediately thereafter by a cooling step. The wire band thus formed is cut into cakes, and these are bent over into clip shape.

It has proved advantageous that a given period of time shall lapse between the covering of the wire band and the time for its further working and for that reason it is suitable that the wire band be wound up on a reel of rather great diameter, for instance in the order of magnitude of about 1 meter. After such a reel has been fed full, it is exchanged for a new reel, and the fully fed reel is removed for continuous working for the production of the clips.

The continuous working comprises cutting clean the surplus of paper or the like outside of the ends of the edges of the wire band, cutting the wire band in suitably long pieces for forming a pile of clips, and bending the pieces of the wire band into clips shape. The pieces of the wire band provided by said cutting will be called in the following a "cake."

The invention will be further described below in connection with a form of execution shown in the attached drawing, but it is understood that the invention is not limited to this specific form of execution, but that all different kinds of modifications may occur within the frame of the invention.

In the drawing, thus,

FIG. 1 shows clips on a highly enlarged scale after production into bent shape, whereas

Figure 2:
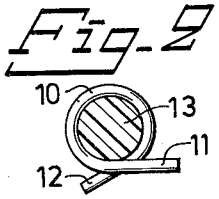
FIG. 2 shows the same clips in its closed state.
Figure 1:
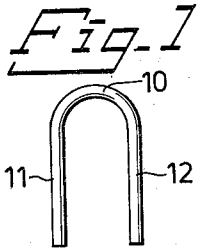

FIG. 1, thus, shows one of a set of clip in its not yet closed state with its bent upper part, "the ridge" 10 and its two legs 11 and 12, and FIG. 2 shows the same one of a set of clip, after it has been closed around a constricted sausage skin 13, and the two legs 11 and 12 have been bent over each other, so that they will cross each other. The wire used to form the clips is formed practically exclusively by hard drawn aluminium wire of circular cross-section, because any other section would cause the result that the two legs 11 and 12 in FIG. 2 would not be tightly attached to each other, the consequence being a defective constriction of the sausage skin. The diameter is dependent upon various factors such as the diameter of the sausage, the thickness of the sausage skin and the material (hard or soft) in the filling. Usually this diameter will be not less than 2 mm and not more than 4 mm.

Figure 3:
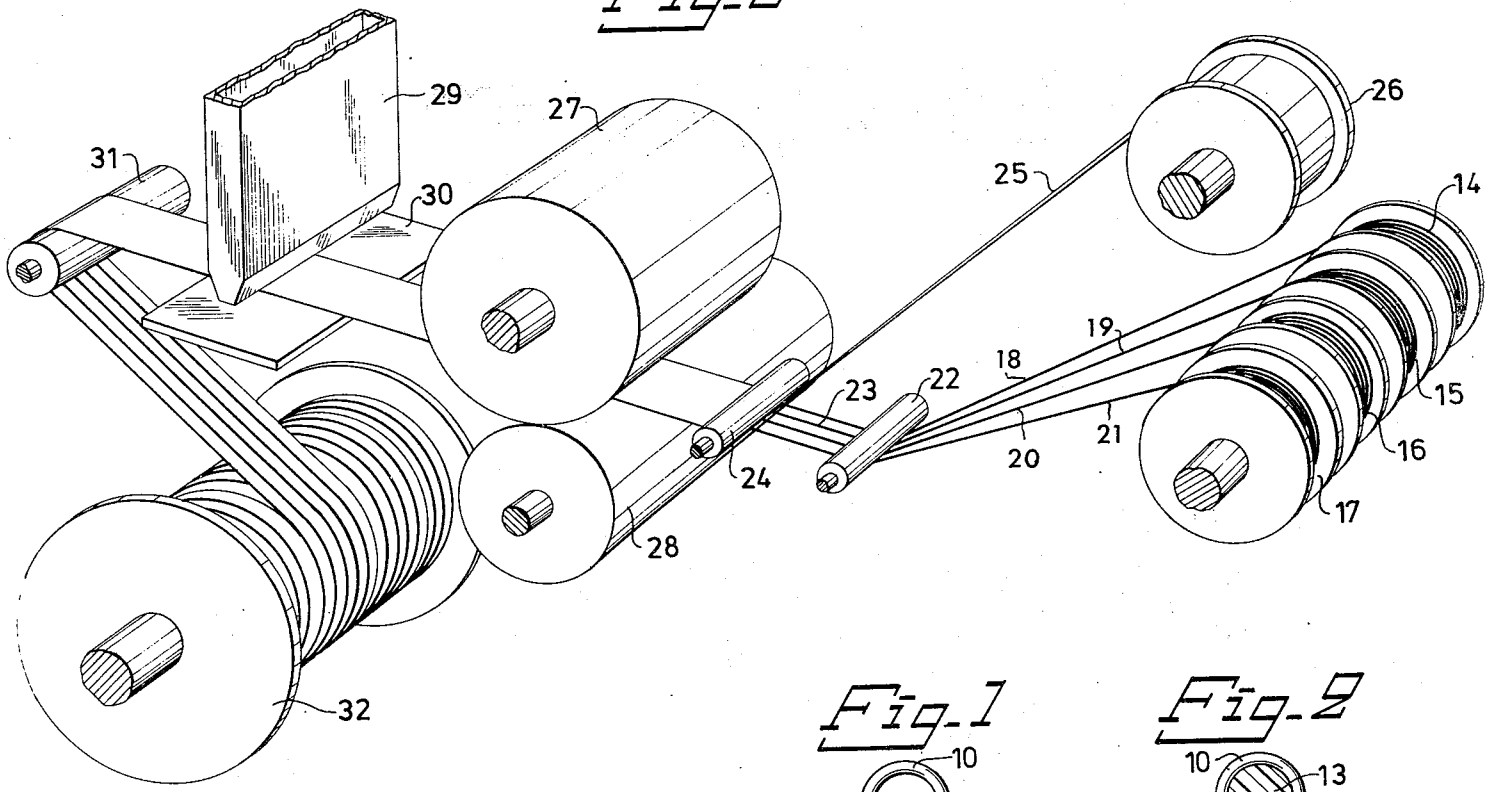
FIG. 3 shows in a perspective schematic area of the different steps in the production of the piles of clips up to the time when the wire band is wound on the reel.

In FIG. 3 four wheels 14, 15, 16 and 17 have been shown, from which the wire can be drawn, but in practice, of course, the number of wheels is much greater. If one wants for instance to have 100 clips in each pile, then the number of wheels must also be 100. The smaller number of wheels has only been shown in the drawing for simplification of the description. The four wires drawn out from the wheels thus have been indicated by 18, 19, 20 and 21. Usually the different wires 18 – 21 form a smaller angle with each other in the plane formed by them, so that the required space is obtained for the wheels 14 – 17 at the side of each other. However they are conducted over a guide roller 22 into a parallel run tightly adjacent to each other for forming the wire band 23. This, thereafter, runs under a further guide roller 24, but simultaneously a paper tape 25 is drawn off from a roller 26 so that this paper tape will be positioned between the guide roller 24 and the wire band 23.

The paper tape in this case is made from craft paper, which has been covered with a suitable plastic. In the tests it has proved that you cannot use any deliberate plastic for this purpose. Thus, the plastic must first for reasons, which will be evident from the following, be a thermoplastic, that means a plastic, which is meltable under influence of heat, in order thereafter to assume a semi rigid state at a subsequent cooling. Further it should be of such a type that it provides a strong bond against the paper in the tape 25 as well as against the aluminium wire in the wire band 23, after it has been heated and re-cooled. Finally, its melting reaction temperature should be lower than the one, which is dangerous for the rigidity of the paper, suitably between 60° and 140° C. Such a plastic which has been found to satisfy all of the above indicated demands is a copolymerization product of poly vinyle acetate and poly ethylene.

A suitable thickness of the craft paper is 70 grams per $m^2$, below in the traditional way mentioned as having a gram weight of 70, and a suitable quantity of the said plastic for covering the paper is 40 grams per $m^2$, or it should have a gram weight of 40, but these values are not at all critical.

A heated roller 27 is arranged to cause instantaneous melting of the plastic cover simultaneously as the paper with its plastic layer is pressed from above onto the wire mat 23. For causing this pressure, the wire mat along with the paper is pressed in between the heated roller 27 and a counter pressure roller 28. In a very little distance from the rollers 27 and 28 the cooling device is provided, shown in the drawing as a cooling air nozzle 29 through which cooling air is blown over the wire mat now covered with paper under plastic bond for cooling the plastic to a stiffening temperature. For preventing the plastic, the paper and the wire mat to be separated during their way from the rollers 27, 28 to the air nozzle 29 a table 30 is provided for carrying up the wire mat along with the plastic covered paper.

After cooling, thus, a bond has been provided between the paper and the separate wires in the wire band, produced by the plastic with which the paper was initially covered, and the wire band, thus combined is thereafter guided over guide roller 31 to a reel 32.

The parts following hereafter in the production of the clips do not form any part of the present invention, and they may therefore be describe in short terms. After the reel 32 has been fully fed with paper covered wire band the wheel is removed and replaced by an empty wheel. The full reel is brought over to the cutting machine, in which the wire band is cut clean from extending paper 25 and thereafter to a second cutting machine, in which the wire band is cut into pieces of a length equal to the length of each separate clips, FIG. 1, in its straightened out state, under formation of so called wire cakes. These are therefore already weakly bent due to having been rolled up on the wheel 32. They are thereafter introduced cake by cake, into a press in which they are given the shape according to FIG. 1. Each cake, in this way, will form a pile of clips which can be brought into a clips driving machine. Such a clips driving machine is already known. When pushing forward a clips by means of the pusher of the machine, this clips is separated from its pile and brought to embrace the constricted sausage and to be bent into the shape shown in FIG. 2.

In practical tests it has been proved that a pile of clips produced in this way is easy to handle, and that it does not show any tendency of falling apart during storing, transportation and other handling, and further that the separation of one of the clips from the pile in the clips machine does not influence the remaining clips in the same pile, so that they will not be released or deformed.

I claim:

1. A method for the production of clips in the form of piles of U-shaped clips releasably connected to each other, which clips are made of wire of circular cross-section which includes a curved upper part and a pair of straight shanks extending therefrom, comprising the steps of; feeding a plurality of lengths of wire in parallel to each other, to a banding apparatus, and arranging the wires thereat into a wire band wherein the wires are tight and adjacent and parallel to each other, introducing a layer of material such as paper or the like against the wire band thus formed, the layer of material being covered with plastic on its side which faces the wires, said plastic being a thermo-plastic having a melting point which is lower than the temperature at which the layer of material will burn or lose observably its strength, thereafter quickly heating the surface of the wire band turned toward the layer along with the layer of material and the thermo-plastic material up to a temperature at or slightly above the melting temperature of the plastic, and immediately thereafter cooling the wire band and layer of material, cutting the wire/-material band into cakes and bending these cakes into clips shape.

2. A method according to claim 1, including winding the wire/material band on a reel, removing the reel from the machine and feeding the said band to a separate arrangement to be cut into cakes and bent into clips shape.

3. A method according to claim 1, in which the layer of material is fed with a width which is slightly greater than the width of the wire band, and wherein the composite wire band/layer of material is thereafter cut clean immediately adjacent to the outermost wires existing on each side, to remove the surplus of said layer of material.

4. A method according to claim 1, in which the said plastic is a copolymerization product of polyvinyl acetate and polyethylene.

5. A method according to claim 1, in which the layer is craft paper having a gram weight of about 70 grams per $m^2$.

6. A method according to claim 1, in which the layer is paper covered with said plastic up to a thickness corresponding to a gram weight of about 40 grams per $m^2$.

* * * * *